US006604526B1

(12) United States Patent
Coward

(10) Patent No.: US 6,604,526 B1
(45) Date of Patent: Aug. 12, 2003

(54) SEXUAL AID HARNESS

(76) Inventor: Donnell King Coward, 11501 Canterbury Ct., Mitchellville, MD (US) 20716

( * ) Notice: Subject to any disclaimer, the term of this patent is extended or adjusted under 35 U.S.C. 154(b) by 0 days.

(21) Appl. No.: 10/062,091

(22) Filed: Feb. 1, 2002

(51) Int. Cl.[7] ..... A61G 15/00
(52) U.S. Cl. ..... 128/845; 128/876; 2/338
(58) Field of Search ..... 128/845, 869, 128/876; 602/19; 2/331, 338

(56) References Cited

U.S. PATENT DOCUMENTS 412,999 A 10/1889 Turney
976,564 A 11/1910 Goodson
1,098,492 A 6/1914 Gibson
1,722,192 A 7/1929 Brokaw
2,909,176 A * 10/1959 Ashe ..... 602/60
4,343,299 A 8/1982 Oxendine, Jr.
4,524,760 A 6/1985 Lerner
4,541,419 A 9/1985 Osawa
4,782,535 A * 11/1988 Yewer ..... 2/338
4,926,845 A 5/1990 Harris
5,054,433 A * 10/1991 Pfleger ..... 2/338
5,178,163 A * 1/1993 Yewer ..... 128/876

* cited by examiner

*Primary Examiner*—Michael A. Brown

(57) ABSTRACT

A sexual harness is disclosed which provides increased stimulation, comfort and support for both participants involved in tandem coitus, and which is of a construction utilizing a plurality of layers, one of which is of an elastically yieldingly compressible material having good deformation memory properties. The device further includes a pair of shoulder straps and leg stirrups for additional attachment to the user.

5 Claims, 5 Drawing Sheets

SEXUAL AID HARNESS

BACKGROUND OF THE INVENTION

1. Field of the Invention

Generally, this device relates to human support harnesses. More particularly, the invention relates to a sexual aid harness that allows one partner to better control the motions of the other partner during tandem coitus.

2. Description of the Prior Art

The sexual drive is one of the most fundamental and urgent drives experienced by all animals and in particular, human beings. For many years, humans have sought to maximize the sensations experienced during sexual intercourse through the use of ointments, aphrodisiacs and man-made devices.

Various adult novelty devices have been proposed which attempt to satisfy the human sex drive. For example, apparatus in the shape of the human penis has been proposed to stimulate the female genitalia during intercourse. These devices stimulate the female by way of vibratory displacement of the female clitoris. For men, fully female functioning mannequins have been proposed as an alternative to coitus with a human female.

However, all of the above proposed devices fail to address an element important to sexual satisfaction—participant comfort.

SUMMARY OF THE INVENTION

It is an object of the present invention to provide a sexual aid harness whereby the rear participant of a coital tandem can better control the pelvic movements of the wearer of the device.

It is a further object the invention to provide sexual aid harness that increases sexual stimulation during coitus.

It is a further object of the invention to provide increased coital comfort for both the rear tandem participant and the wearer of the device.

Additional objects and advantages of the invention will be set forth in the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention as embodied and broadly described herein, a sexual aid harness is provided, comprising:

a. a belt body having a central axis and a generally elongated configuration, two linearly opposed side edges and two opposed arcuate end portions, the belt body further including
   i. an inner layer of stretchable fabric;
   ii. an intermediate layer, substantially coextensive in size and shape with said inner layer and joined thereto, of an elastically yieldingly compressible and shape-restoring foam material having a thickness greater than that of said inner layer;
   iii. an outer layer of stretchable fabric substantially coextensive in size and shape with said inner layer and said intermediate layer and joined thereto;
   iv. a strapping layer, coextensive in size and shape with said inner layer and said intermediate layer and said outer layer and joined thereto, and having a plurality of geometrically shaped cutouts, each cutout having a centerline that is coaxial with the central axis of the belt body;

b. primary grasping means situated between said outer layer and said strapping layer and attached thereto; and, c. fastening means for securing the belt body generally around the waist of the wearer.

These and other objects and advantages of the invention will be apparent from the following detailed description and from the drawings.

BRIEF DESCRIPTION OF THE DRAWINGS

Referring to the drawings, indicated generally at 10 is a device in accordance with the invention. FIG. 1 shows device 10 generally comprises a belt body 12 having a generally elongated configuration. The belt body 12 has an interior layer 14, an intermediate layer 16, and exterior layer 18 and a strapping layer 20. Connected to an upper periphery 22 of the belt body 12 are first and second shoulder straps 24 and 26. The device further includes first and second leg stirrups 28 and 30 connected to a lower periphery 32 of belt body 12 by a pair of adjustable straps 34 and 36.

With reference to FIG. 1, the belt body 12 has an elongated configuration defined by two opposed and parallel linear side edges defined by an upper edge 22 and a lower edge 32. Each of the upper edge 22 and the lower edge 32 terminate at a first end 38 and a second end 40. Two opposed arcuate end portions define the first and second ends 38 and 40 of the belt portion. It should be appreciated that the length of the upper edge 22 and the lower edge 32 can be varied to accommodate users with various waist sizes. Similarly, the width of the arcuate end portions are not limited to that shown in the illustration, but can also be varied for user comfort.

Figure 3:
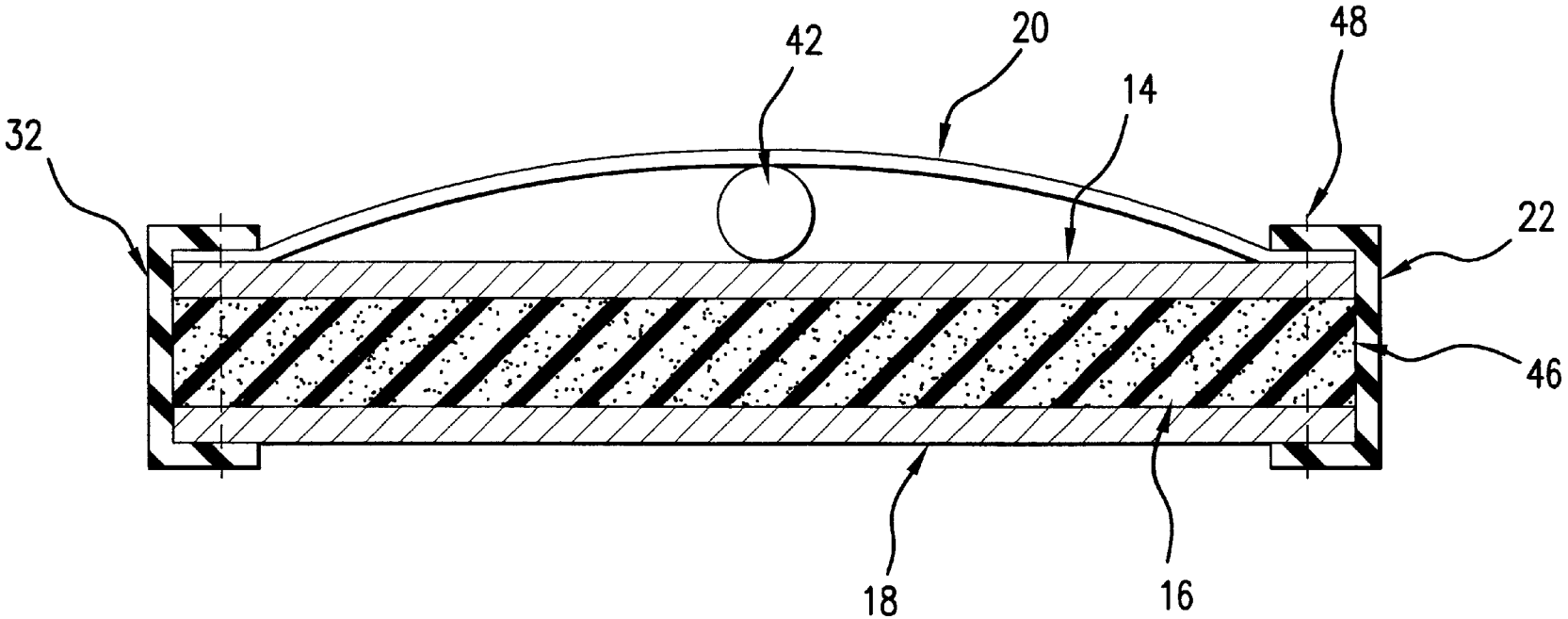
FIG. 3 is a cross-sectional view taken along lines 3—3 of FIG. 1.

With reference to the cross-sectional view of FIG. 3, it will be noted that the belt body is comprised of several layers: an exterior layer 14; an intermediate layer 16; an interior layer 18; and, a strapping layer 20. At the outset, it should be pointed out that all layers mirror the dimensions of the belt body 12 as described above. The exterior layer 14 is preferably manufactured from a stretchable or expandable fabric, such as, "Lycra." Another appropriate material of manufacture may also include Spandex, a readily available elastic fabric material of proven durability and particularly high strength characteristics. The interior layer 18 is also manufactured from a stretchable or expandable fabric, for example brushed 100% polyester or nylon. The interior layer 18 may include a fuzzy texture for increased comfort and absorption of excess perspiration experienced by individuals engaged in coitus. The interior and exterior layers are preferably tightly woven webs that provide a closed weave and a generally solid unbroken surface. The properties of the preferred materials allow for the passage of air and perspiration despite its closed weave configuration.

Further disclosed in FIG. 3 is intermediate layer 16. Intermediate layer 16 is preferably manufactured of a material with superior deformation memory characteristics that tends to extend the life of the belt after frequent use. Although the preferred material of manufacture is polyethylene foam, it should be understood that any material having the deformation memory characteristics described above would be suitable.

The interior, exterior and intermediate layers may be combined by any method known to those with ordinary skill in the art. However, a preferred method of combining the layers includes a lamination or bonding process with a flexible adhesive. In one heat bonding process, a thin urethane foam layer is first applied to each of the inner and outer layer surfaces that face the foam layer and the composite is passed over a gas flame bar and into pinch rollers, which laminates the thin foam layers onto the surfaces of the fabric layers. Each fabric/urethane foam lamination is then applied on the respective surface of the intermediate layer 16 with the urethane foam layer facing the intermediate layer 16 and the composite is run over the flame bar and into pinch rollers, for each side.

A generally longitudinal, rope-like first grip 42 is operably attached at both ends of belt body 12. First grip 42 can be comprised of any material that can be manufactured into a generally rope-like shape. Such materials include nylon, plastics, and foam rubber with nylon being the preferred material. Both ends of the first grip are attached using conventional devices such as pins or male snaps.

Figure 1:
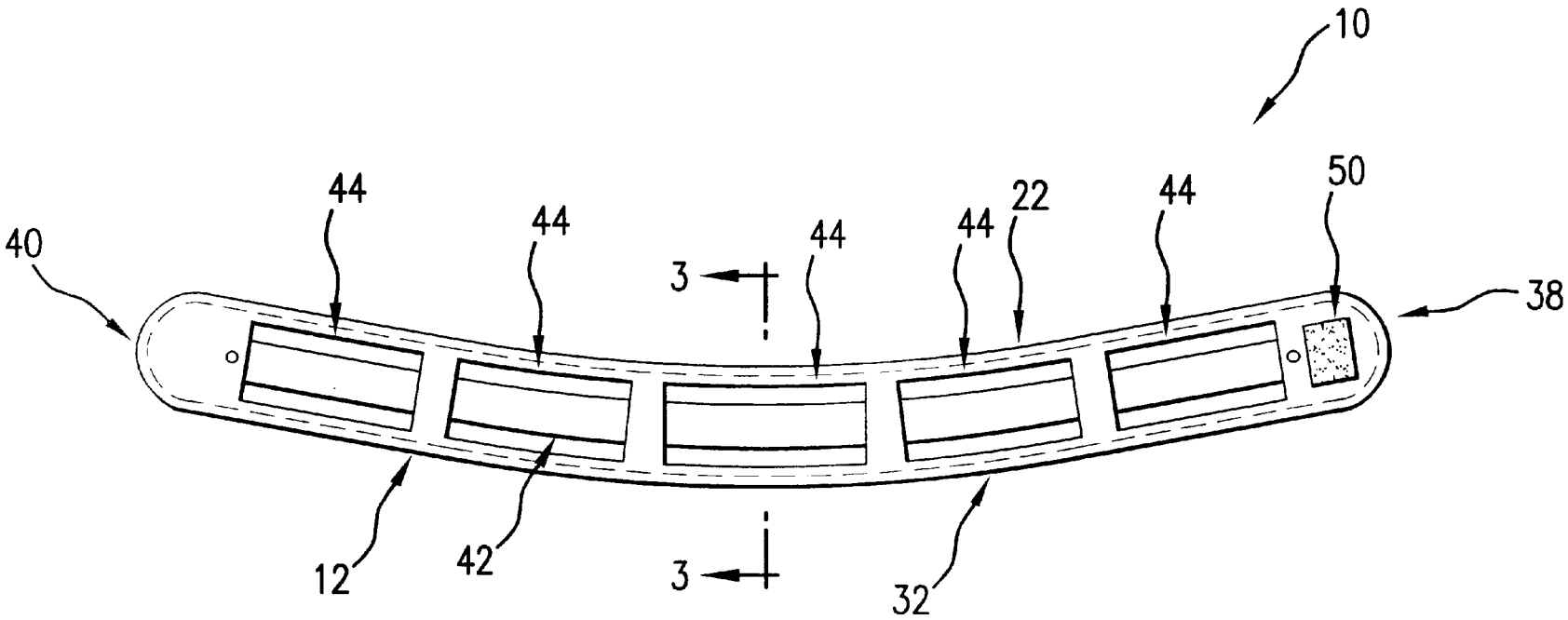
FIG. 1 is an exterior view of the belt constructed in accordance with the present invention.
Figure 2:
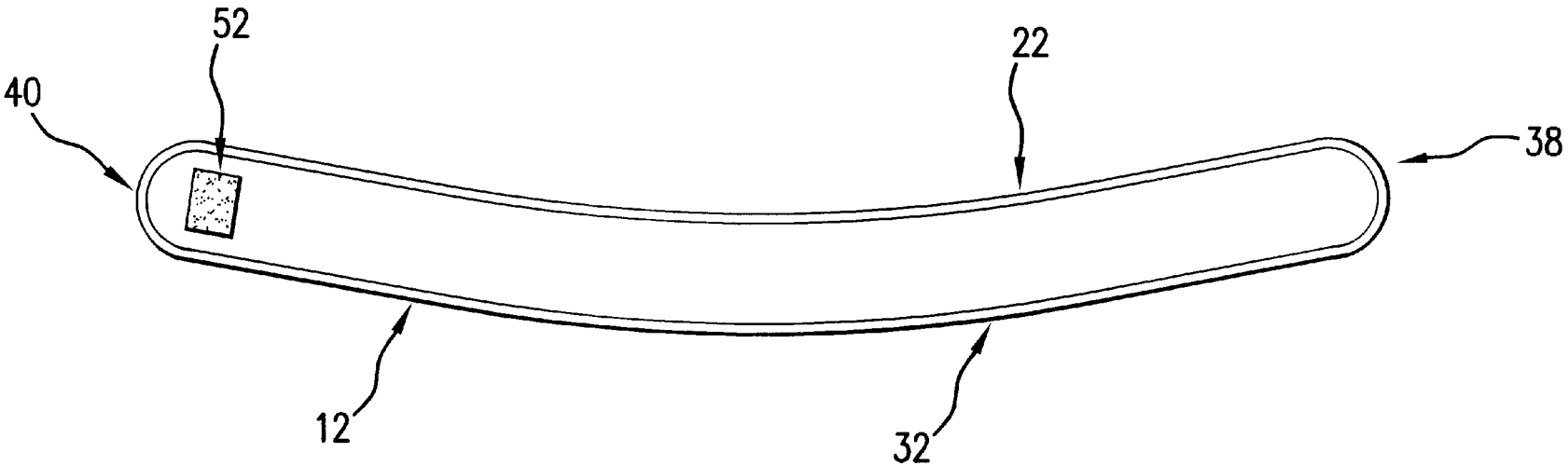
FIG. 2 is an interior view of the belt constructed in accordance with the present invention.

The outermost layer, the strapping layer 20, is shown in FIG. 2. Referring back to FIG. 1, it can be shown that the strapping layer 20 mirrors the dimensions of the belt body 12 as described above and are positioned adjacent to the first grip 42. The strapping layer 20 further includes a series of geometrically shaped cutouts 44. Although the drawings disclose the shape of the cutouts as being square, it should be appreciated that any suitable shape and size may be used. Preferably, the shape and size of the cutout are such that a human hand may have easy access to the space created thereby. Any suitable material may be used for the strapping layer including those disclosed for use with the inner and outer layers 18, 14. However, leather has always been the material of choice for its characteristics of durability and aesthetic pleasure and therefore is the preferred material of use. The strapping layer 20 may be joined to the outer layer 14 by an adhesive or any other suitable bonding product or process.

FIG. 3 shows that all layers terminate in the upper edge and lower edge as described above. The exposed edges may be bound together by a binder 46 made of any suitable material such as nylon or leather. The binder 46 is attached around the exposed edges by preferably a stitching 48 suing heavy-duty nylon thread or in any conventional manner. The stitching 48 of the strip is located adjacent to the free edges of the binder 46 and both the inner edge of the binder and the outer edge are stitched in a single pass as shown in FIG. 1.

Further included in the belt body 12 are belt fastening means as indicated generally at 50 and 52 and disposed as shown on opposite end portions of the belt body 12 to securely fasten the same together and thus secure the belt body around the waist of the user. As best seen in FIG. 1 of the application drawings, the fastening means 50 comprise a generally square-shaped pad of loop material, for example Velcro, which overlies the material of the belt body 12 at the second end portion 28 thereof, and the respective outer edges of which underlie the belt body and are thus securely attached to the belt body 12 by stitching. The fastening means 52 comprise a generally square-shaped pad of hook material, again for example Velcro, which underlie the material of the belt body 12 at the first portion thereof. The outer edges of the pad again underlie the belt body 12 for secure attachment to the belt body 12 by stitching. While the use of a pad of hook and loop material of, for example Velcro, is preferred, it is to be appreciated that any means of securing the first and second ends 38 and 40 may be employed. Such other means include a strap/D-ring combination and snap buckles, all of which are known in the art.

A pair of non-elastic shoulder straps 24 and 26 is shown having one end fixedly connected to inner layer 18 and another end adapted for adjustable connection through the respective of strap connectors 56 and 58, to a sliding connector 60 operating with the straps 24 and 26, in known manner. The non-elastic shoulder straps 24 and 26 provide the desired result of inhibiting rotation of the shoulders of the body with respect to the pelvis. This allows the rear-most tandem participant to better control the hip movements of the wearer. Adjustment of the straps via connectors 56 and 58 and cooperating sliding elements 60 on the straps is well known in the art.

Support members 62 and 64 operably attach shoulder straps 24 and 26 to the belt body. As shown in FIG. 1, support member 62 is rigidly connected to strap connector 56, while support member 64 is rigidly connected to strap connector 58. Support members 62 and 64 may be formed of strips of generally inelastic material sewn or otherwise attached to the inner surface 18 of the belt body 12.

In a position that is generally opposite to that of the shoulder straps 24 and 26 are attached a pair of leg stirrups 28 and 30. Leg stirrups 28 and 30 are defined by an elongated strip of material similar in construction to that of the belt body 12. That is, the leg stirrup straps 28 and 30 are comprised of an interior layer, an intermediate layer, and an exterior layer. Each layer is formed of materials the same as or similar to the materials disclosed for layers 14, 16 and 18 of the belt body 12 and are likewise assembled in a similar manner. The obvious difference between the leg stirrups 28 and 30 and the belt body 12 is that the dimensions of the leg stirrups are reduced to accommodate the size of a user's thighs. Leg stirrups 28,30 further include the fastening means 66 and 68, and alternatives thereof, as described above for the belt body.

Leg stirrups 28 and 30 are attached to belt body 12 in a manner similar to that of shoulder straps 24 and 26. That is, the lower edge 32 of the belt body contains a pair of spaced-apart lower support members 70 and 72 attached by the stitching process described herein. A pair of stirrup straps 34 and 36 is operably attached to the supports 70 and 72 by stitching or other suitable means.

Figure 4:
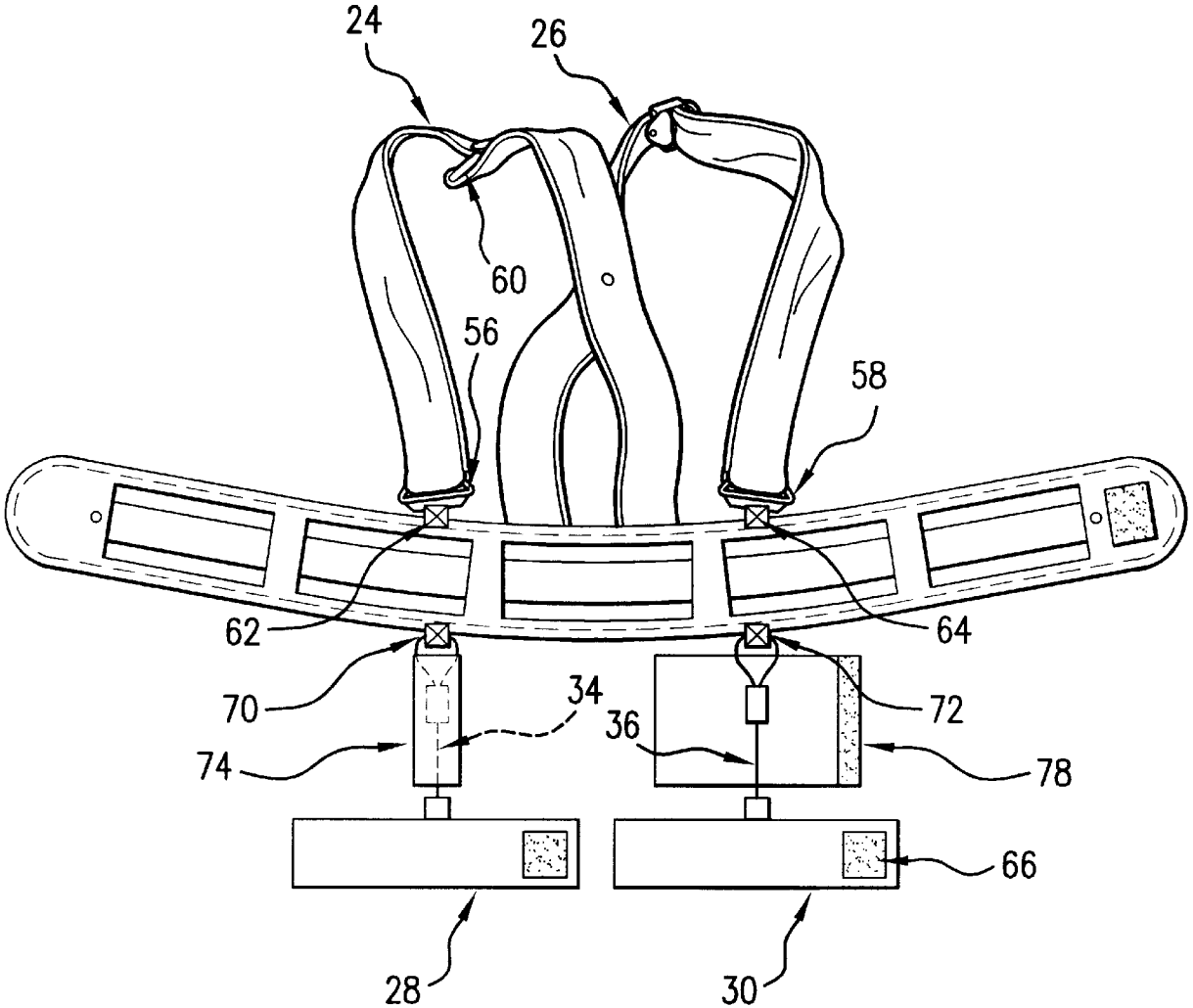
FIG. 4 is an illustration of an alternate embodiment of the invention

Additionally, as illustrated in FIG. 4, second gripping means 74 and 78 may be included to provide an extra means of support for the rear tandem participant.

The second gripping means 74, 78 are comprised of a piece of material encircled around stirrup straps 34 and 36.

The second gripping means 74, 78 having first and seconds ends and being adjustably attached to each of the first and second leg strips at the first end and to the belt body at a second end. Preferably, the piece of material to be used for the second gripping means comprises rubber or rubber-like material. However, it should be appreciated that any other soft material may be used instead. Such other materials include cotton, polyesters and nylons.

Figure 5:
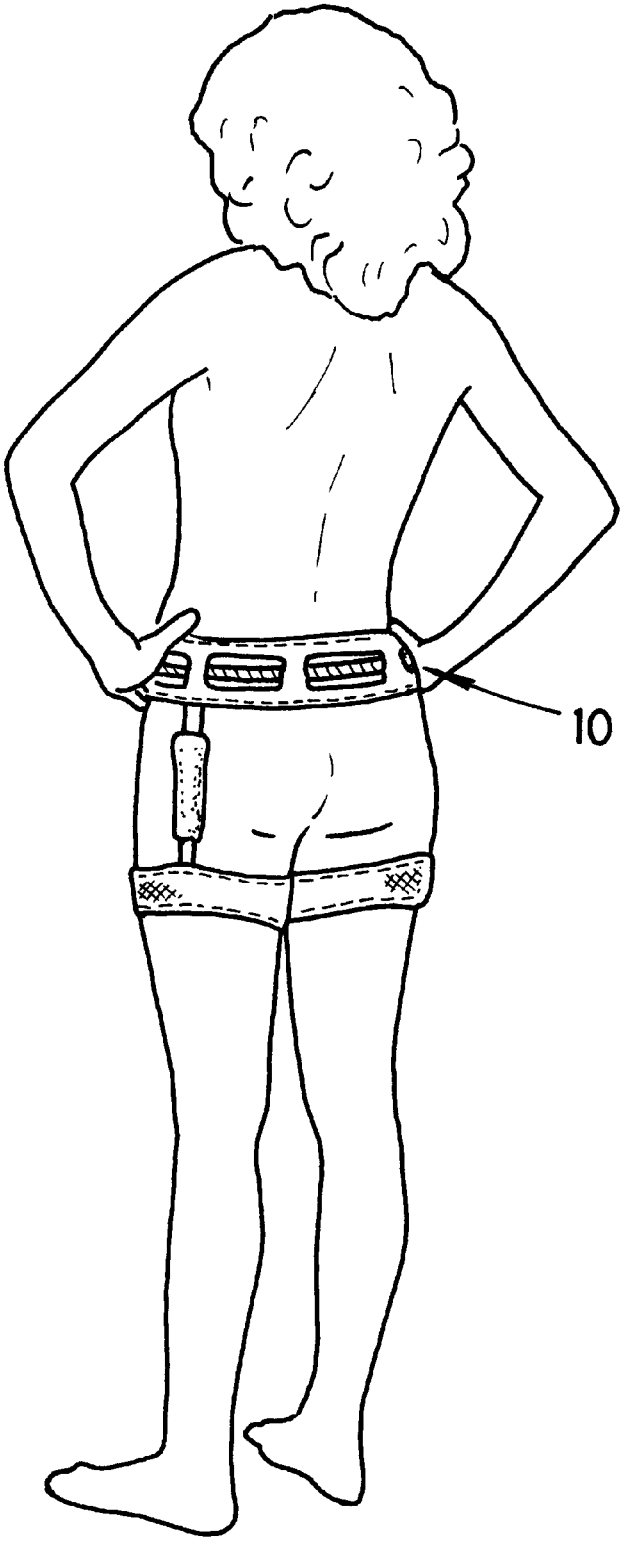
FIG. 5 is a perspective showing the invention as worn by a forward partner engaged in tandem coitus.

As illustrated in FIG. 5, the forward person of a tandem pair engaged in coitus is the wearer of the device 10. The forward participant places the belt body 12 about the waist and pulls it taut until comfortable. The belt 12 is then removably secured about the waist of the user by the fastening means as described above. To increase the stability of the belt about the waist of the wearer, either or both of the shoulder straps 24, 26 or leg stirrups 28, 30 may be removably attached to the belt body 12. The leg stirrups 28, 30 are attached to each thigh in a manner similar to that disclosed for the belt body 12.

Those skilled in the art will readily recognize that this invention may be embodied in still other specific forms than illustrated without departing from the spirit or essential characteristics of it. The illustrated embodiment is therefore to be considered in all respects illustrative and not restrictive, the scope of the invention being indicated by the appended claims rather than the foregoing description; and all variations that come within the meaning and range of equivalency of the claims are therefore intended to be embraced thereby.

What is claimed is:

1. A sexual aid harness for individuals engaged in tandem coitus, comprising:

a. a belt body having a central axis and a generally elongated configuration, two linearly opposed side edges and two opposed arcuate end portions, the belt body further including i. an inner layer of stretchable fabric;

ii. an intermediate layer, substantially coextensive in size and shape with said inner layer and joined thereto, of an elastically yieldingly compressible and shape-restoring foam material having a thickness greater than that of said inner layer;

iii. an outer layer of stretchable fabric substantially coextensive in size and shape with said inner layer and said intermediate layer and joined thereto;

iv. a strapping layer, coextensive in size and shape with said inner layer and said intermediate layer and said outer layer and joined thereto, and having a plurality of geometrically shaped cutouts, each cutout having a centerline that is coaxial with the central axis of the belt body;

b. primary grasping means situated between said outer layer and said strapping layer and attached thereto; and, c. fastening means for securing the belt body generally around the waist of the wearer.

2. The sexual aid harness of claim 1 further including, a pair of non-elastic shoulder straps each having first and second ends operably attached to the upper edge of said belt body.

3. The sexual aid harness of claim 2 further including, a. first and second leg stirrups each having a central axis and a generally elongated configuration, two linearly opposed side edges and two opposed arcuate end portions, fastening means for securing the leg stirrups generally about the thigh of a user; and, b. secondary grasping means having first and second ends and being adjustably attached to said each of said first and second leg stirrups at said first end and to the belt body at a second end.

4. The sexual harness of claim 1, wherein the intermediate layer is of a foam elastomer material.

5. The sexual harness of claim 4, wherein the foam elastomer material includes a heat combining, heat sensitive film deposited on opposite surfaces thereof.

* * * * *